US012607368B2

(12) United States Patent
De Munter et al.

(10) Patent No.: US 12,607,368 B2
(45) Date of Patent: Apr. 21, 2026

(54) CLEAN ROOM SYSTEM AS WELL AS A COMPUTER IMPLEMENTED METHOD FOR CONTROLLING SUCH CLEAN ROOM SYSTEM

(71) Applicant: Neuroplast Beheer B.V., Geleen (NL)

(72) Inventors: Johannes Petrus Jozef Maria De Munter, Geleen (NL); Ekkehard Lang, Geleen (NL)

(73) Assignee: Neuroplast Beheer B.V., Geleen (NL)

( * ) Notice: Subject to any disclaimer, the term of this patent is extended or adjusted under 35 U.S.C. 154(b) by 440 days.

(21) Appl. No.: 18/031,961

(22) PCT Filed: Oct. 13, 2021

(86) PCT No.: PCT/EP2021/078358
§ 371 (c)(1),
(2) Date: Apr. 14, 2023

(87) PCT Pub. No.: WO2022/079121
PCT Pub. Date: Apr. 21, 2022

(65) Prior Publication Data

US 2023/0408116 A1 Dec. 21, 2023

(30) Foreign Application Priority Data

Oct. 16, 2020 (EP) ..... 20202396

(51) Int. Cl.
*F24F 3/167* (2021.01)
*F24F 8/108* (2021.01)
(Continued)

(52) U.S. Cl.
CPC ..... *F24F 3/167* (2021.01); *F24F 8/108* (2021.01); *F24F 11/49* (2018.01); *F24F 11/54* (2018.01)

(58) Field of Classification Search
CPC ..... F24F 3/167; F24F 11/54; F24F 11/56
See application file for complete search history.

(56) References Cited

U.S. PATENT DOCUMENTS 4,693,175 A * 9/1987 Hashimoto ..... F24F 3/167 55/385.2
5,058,491 A * 10/1991 Wiemer ..... F24F 3/167 454/49

(Continued)

FOREIGN PATENT DOCUMENTS

CN 106288059 1/2017
GB 2551714 1/2018

(Continued)

OTHER PUBLICATIONS

International Search Report & Written Opinion, International Patent Application No. PCT/EP2021/078358, dated Feb. 21, 2022, 13 pages.

*Primary Examiner* — Mohammad Ali
*Assistant Examiner* — Vincent W Chang
(74) *Attorney, Agent, or Firm* — Casimir Jones, S.C.; Robert A. Goetz

(57) ABSTRACT

The invention relates to the field of clean room facilities for manufacturing of a pharmaceutical product or item according to a sequence of manufacturing steps under extreme low levels of particulates. According to a first aspect of the disclosure a clean room mimicking system is proposed, for example for the manufacturing of a pharmaceutical product or item according to a sequence of manufacturing steps under extreme low levels of particulates, the clean room system at least comprising one clean room facility being composed of multiple air conditioned compartments, each of the multiple air conditioned compartments equipped for performing at least one of the manufacturing steps, wherein the multiple air conditioned compartments are mechanically (Continued)

interconnected and each are constructed in accordance with an associated clean room classification ranging from high to low in terms of the number and size of particulates permitted per volume of air, seen in the direction of the sequence of manufacturing steps through the clean room facility.

13 Claims, 4 Drawing Sheets

(51) Int. Cl.
*F24F 11/49* (2018.01)
*F24F 11/54* (2018.01)

(56) References Cited

U.S. PATENT DOCUMENTS 5,096,477 A 3/1992 Shinoda et al.
5,195,922 A * 3/1993 Genco ..... F24F 3/167 454/187
5,259,812 A * 11/1993 Kleinsek ..... F24F 3/167 312/1
2003/0045226 A1 3/2003 Yokoyama et al.
2007/0253831 A1 11/2007 Lee
2014/0137493 A1 5/2014 Mouzannar
2015/0056909 A1* 2/2015 Chien ..... F24F 11/30 454/187
2015/0320640 A1* 11/2015 Christensen ..... A61J 1/201 29/428
2016/0008757 A1* 1/2016 Gromala ..... A61L 9/12 423/210
2016/0010883 A1* 1/2016 Jornitz ..... E04H 1/005 29/897.3
2016/0010884 A1* 1/2016 Holtz ..... F24F 8/00 454/187
2019/0234631 A1* 8/2019 Wallace ..... B01L 1/04
2019/0285295 A1* 9/2019 Tripathii ..... F24F 7/007
2021/0390474 A1* 12/2021 Ranjan ..... G06Q 10/06312

FOREIGN PATENT DOCUMENTS

JP 2006-107139 A 4/2006
JP 2014-098545 A 5/2014
JP 2016-087261 A 5/2016
JP 2017-176984 A 10/2017
KR 200397619 10/2005
WO 2018/002589 A1 1/2018
WO 2019/138304 A1 7/2019

* cited by examiner

CLEAN ROOM SYSTEM AS WELL AS A COMPUTER IMPLEMENTED METHOD FOR CONTROLLING SUCH CLEAN ROOM SYSTEM

TECHNICAL FIELD

The invention relates to the field of clean room facilities for manufacturing of a pharmaceutical product or item according to a sequence of manufacturing steps under extreme low levels of particulates. In particular the invention pertains to clean room systems implementing such clean room facilities as well as a computer implemented method for controlling such clean room system, in particular for monitoring the sequence of manufacturing steps of a pharmaceutical product or item.

BACKGROUND OF THE INVENTION

A cleanroom or clean room facility are commonly known and are part of specialized industrial production or scientific research, including the manufacturing of pharmaceutical items, integrated circuits, CRT, LCD, OLED and microLED displays. Cleanrooms are designed to maintain extremely low levels of particulates, such as dust, airborne organisms, or vaporized particulates. Cleanrooms typically have a cleanliness level quantified by the number of particulates per cubic meter at a predetermined molecule measure.

Cleanrooms can be very large. Entire manufacturing facilities can be contained within a cleanroom with factory floors covering thousands of square meters. They are used extensively in semiconductor manufacturing, solar panel, rechargeable battery, LED, LCD and OLED display manufacturing, biotechnology, the life sciences, and other fields that are very sensitive to environmental contamination.

In order to prevent any environmental contamination within the clean room facility, extensive technical measures are undertaken to maintain the desired cleanliness level inside. One of such technical measures is the filtering and cooling of the outside air entering the clean room facility using progressively finer filters to exclude dust. Also, within the clean room facility the air inside is constantly recirculated through fan filter units containing high-efficiency particulate air (HEPA), and/or ultra-low particulate air (ULPA) filters to remove internally generated contaminants.

Also, special lighting fixtures, walls, equipment and other materials are used to minimize the generation of airborne particles inside the clean room area. Furthermore, the air temperature and humidity levels inside the clean room are continuously controlled and the occurrence of unwanted static electricity is neutralized using ionizing bars.

Another technical measure for maintaining the desired cleanliness level inside, is the necessity of airlocks, sometimes including an air shower stage, for staff personnel entering and leaving through. Additionally, the staff personnel are required wear protective clothing such as hoods, face masks, gloves, boots, and coveralls, in order to minimize the risk of carrying particulates by the person, when entering the clean room facility. Furthermore, clean room facilities need to conform to internationally standardized classifications and need to be tested and approved on site by competent authorities, before the clean room facility is allowed to startup the manufacturing process of pharmaceutical items, integrated circuits, CRT, LCD, OLED and microLED displays, etc.

Clean rooms are classified in accordance with internationally standardized classifications or grades of cleanliness.

Depending the grade of cleanliness (A, B, C or D, with A denoting the highest level of cleanliness and D denoting the lowest level of cleanliness), the clean room is a system with different compartments at different grade of cleanliness for people and goods. People have to gown several times before entering the C or B environment and goods also have to be unpacked several times before entering the C or B environment.

All the above factors contribute to the fact that clean room facilities are complex and expensive, in terms of construction, the required training of highly skilled personnel, as well as long term maintenance and limited time periods for employees to work inside clean rooms. Thus, the setting up of such complex clean room infrastructures requires a significant ground floor foot print of the overall clean room facility and are often exclusive to the high tech industries and predominately developing countries.

The present invention aims to provide a less complex and less expensive clean room mimicking facility, which can be set up at locations which previously had not the beneficial conditions for setting up such clean room facility, and which allows such clean room facility to be operated in less strict environments, and with a reduced ground floor foot print, whilst conforming to the highest, internationally standardized classifications.

Another advantage of the present invention is the fact that employees do not have to gown extensively and are not working in conditioned and higher pressured rooms, overcoming the classical clean room limitations. This enables more efficient manufacturing of products without jeopardizing the safety of the product.

SUMMARY OF THE INVENTION

According to a first aspect of the disclosure a system mimicking all features of a clean room system is proposed, for example for the manufacturing of a pharmaceutical product or item according to a sequence of manufacturing steps under extreme low levels of particulates, the clean room system at least comprising one clean room facility being composed of multiple air conditioned compartments, each of the multiple air conditioned compartments equipped for performing at least one of the manufacturing steps, wherein the multiple air conditioned compartments are mechanically interconnected and each are constructed in accordance with an associated clean room classification ranging from high to low in terms of the number and size of particulates permitted per volume of air, seen in the direction of the sequence of manufacturing steps through the clean room facility.

By constructing the clean room facility in a modular manner, with multiple compartments mechanically interconnected, each assigned to or equipped for performing at least one of the manufacturing steps of the sequence of manufacturing and each being constructed in accordance with an associated clean room classification, allows for a less complex clean room construction. The manufacturing steps requiring a low or lowest number and size of particulates permitted per volume of air are performed in technically more complex and advanced (and hence expensive) air conditioned clean room compartments, whereas less technically complex air conditioned clean room compartments can be used for the manufacturing steps, which are to be performed under less strict clean room requirements (hence under atmosphere conditions allowing a larger number and large size of particulates). This allows the implementation of such clean room system with a clean room facility as outlined above in areas (countries) with less demands to the infrastructure, as with the present disclosure only parts of the clean room facility need to conform to the most stringent requirements of clean room classifications.

In addition, other complex technical measures, such as air locks etc. can be obviating, and the staff personnel do not need to dress in protective clothing, which significantly simplifies the operation of such clean room system and facility. The above advantage is further emphasized as the staff personnel do not need to work in over pressured environments. It also significantly reduces the ground floor foot print and enhances the efficiency of the overall clean room facility.

To maintain overall governance and quality assurance of the manufacturing process of a pharmaceutical product or item according to a sequence of manufacturing steps in an example the clean room system further comprises at least one clean room facility control unit located at the site of each of the at least one clean room facility, as well as a clean room system control unit located remote from the site of each of the at least one clean room facility, both at least one clean room facility control unit and the remote clean room system control unit being operatively interconnected in a data-communication network, wherein the clean room facility control unit is structured for obtaining and storing parameter data pertaining to parameters related to the manufacturing steps of the pharmaceutical product or item being performed at the associated clean room facility, as well as transmitting, via the data-communication network, the parameter data to the clean room system control unit and wherein the clean room system control unit is structured to: receive, via the data-communication network, the parameter data transmitted from the at least one clean room facility control unit, compare the parameter data with pre-determined reference parameter data, and controlling, based on the comparison, the manufacturing of the pharmaceutical product or item being performed at the associated clean room facility.

Herewith a sophisticated yet de-central system for the manufacturing of a pharmaceutical product or item is established, wherein in real time various manufacturing process parameters are measured at the associated clean room facility, and transmitted to an off-site central system control unit for monitoring and comparing with desired, pre-determined manufacturing process parameters. This off-site control can be performed by high qualified staff personnel working at the off-site clean room system control unit, which subsequently are not needed to be employed at the site of the clean room facility where the actual manufacturing process is taking place.

The manufacturing process at the associated clean room facility can be controlled, based on the comparison between the process parameters being measured or detected with the desired, pre-determined process parameters. This controlling of the manufacturing process can for example include quality approval and release (for use or selling) of the pharmaceutical product or item being manufactured, adapting the manufacturing process, or even interrupting (temporarily or permanent) the manufacturing process in the event that the comparison shows the measured process parameters being out-of-spec.

In a further example, each of the plurality of air conditioned compartments is provided with a HEPA or ULPA air filter device conformal with the associated clean room classification. Herewith it is not necessary to construct a clean room facility in accordance with the highest and most stringent requirements of clean room classifications, but only part of it, in which the manufacturing steps to be performed require these highest, most stringent clean room requirements, that is requiring a clean room environment with a low or lowest number and size of particulates permitted per volume of air.

In a further example of the disclosure, the clean room system comprises at least one air permeable transfer passage between two mechanically interconnected air conditioned compartments. This allows the transfer of a semi-finished item from an air conditioned compartment with a clean room atmosphere with a high number and large size of particulates towards an air conditioned compartment with a clean room atmosphere with a lower number and smaller size of particulates for performing a manufacturing step requiring these air atmosphere requirements.

Preferably, the at least one air permeable transfer passage is formed as an air permeable door, which is hingable or slidable mounted with an air conditioned compartment. The at least one air permeable transfer passage or air lock between the compartments is constructed in a way, that pressure cascades between the compartments are established, not allowing air to flow back and to ensure the air specification regarding particles, temperature, humidity and pressure In a further example of the disclosure, each of the multiple air conditioned compartments of the at least one clean room facility accommodates at least one detector for detecting at least one parameter related to the manufacturing step being performed in the compartment and for generating the parameter data in response to the parameter being detected. Additionally, the at least one detector is comprised in a manufacturing device accommodated in the at least one air conditioned compartment. Herewith a continuous monitoring is guaranteed of the several stages of the manufacturing process of the pharmaceutical product or item and allows in the clean room system a continuous, real-time assessment of the quality of the manufacturing steps and if necessary the remote control of the manufacturing process by high qualified staff personnel, which are not needed to be employed at the site of the clean room facility where the actual manufacturing process is taking place.

In multiple examples, the at least one detector is one selected but not limited from the group of a pressure detector, a temperature detector, a humidity detector, a video camera, a time dimension.

To improve the oversight and controlling on-site of the manufacturing process, at least one of the multiple air conditioned compartments may comprise an input/output interface for inputting setting data pertaining to at least one parameter related to a manufacturing step and for displaying parameter data pertaining to at least one parameter related to the manufacturing step being performed in the compartment. This oversight an on-site control can be performed, if needed, by less technically qualified staff personnel.

In a preferred example of the clean room system and clean room facility allowing an optimal clean room atmosphere control needed for a manufacturing step, at least one of the multiple air conditioned compartments of each clean room facility is constructed as a glove box. Implementing an air conditioned compartment as a glove box significantly reduces the ground floor foot print of the overall clean room facility The invention also relates to a clean room facility and an air conditioned compartment for use in a clean room facility, both according to the disclosure.

In a further example of the invention, a computer implemented method for the remote controlling of a clean room system according to the disclosure is proposed, the computer implemented method comprising the steps of:

monitoring, at a site remote from the at least one clean room facility, the sequence of manufacturing steps for manufacturing of a pharmaceutical product or item at the at least one clean room facility, acquiring parameter data pertaining to parameters related to the manufacturing steps being performed at the associated clean room facility, comparing, at the site remote from the at least one clean room facility, the acquired parameter data with pre-determined reference parameter data, and controlling, based on the comparison, the manufacturing of the pharmaceutical product or item being performed at the associated clean room facility.

In particular, the method step of controlling comprises the steps of:

interrupting the manufacturing of the pharmaceutical product or item being performed at the associated clean room facility if the acquired parameter data does not concur with the pre-determined reference parameter data;

reviewing, from the site remote from the at least one clean room facility, the sequence of manufacturing steps and the parameter data at the associated clean room facility, adapting, from the site remote from the at least one clean room facility, the sequence of manufacturing steps and the parameter data at the associated clean room facility, and restarting the manufacturing of the pharmaceutical product or item being performed at the associated clean room facility.

The above steps allows for setting up a sophisticated yet de-central system for the manufacturing of a pharmaceutical product or item at several clean room facilities at different locations, wherein in real time various manufacturing process parameters are measured at the associated clean room facility, and transmitted via the data-communications network to the off-site central system control unit for monitoring and comparing with desired, pre-determined manufacturing process parameters. This off-site control can be performed by high qualified staff personnel working at the off-site clean room system control unit, which subsequently are not needed to be employed at the site of the clean room facility where the actual manufacturing process is taking place.

With the computer implemented method according to the disclosure, the manufacturing process at several associated clean room facilities can be controlled in real-time, based on the comparison between the process parameters being measured or detected with the desired, pre-determined process parameters and transmitted via the data-communications network. This controlling of the manufacturing process can for example include quality approval and release (for use or selling) of the pharmaceutical product or item being manufactured, adapting the manufacturing process, or even interrupting (temporarily or permanent) the manufacturing process in the event that the comparison shows the measured process parameters being out-of-spec.

The disclosure also relates to a computer program or computer program product comprising instructions which, when the program is executed by a computer, cause the computer to carry out steps of the computer implemented method according to the disclosure, as well as a computer-readable storage medium comprising instructions which, when executed by a computer, cause the computer to carry out steps of the computer implemented method according to the disclosure.

BRIEF DESCRIPTION OF THE DRAWINGS

The invention will now be discussed with reference to the drawings, which show in.

DETAILED DESCRIPTION OF THE INVENTION

Figure 1:
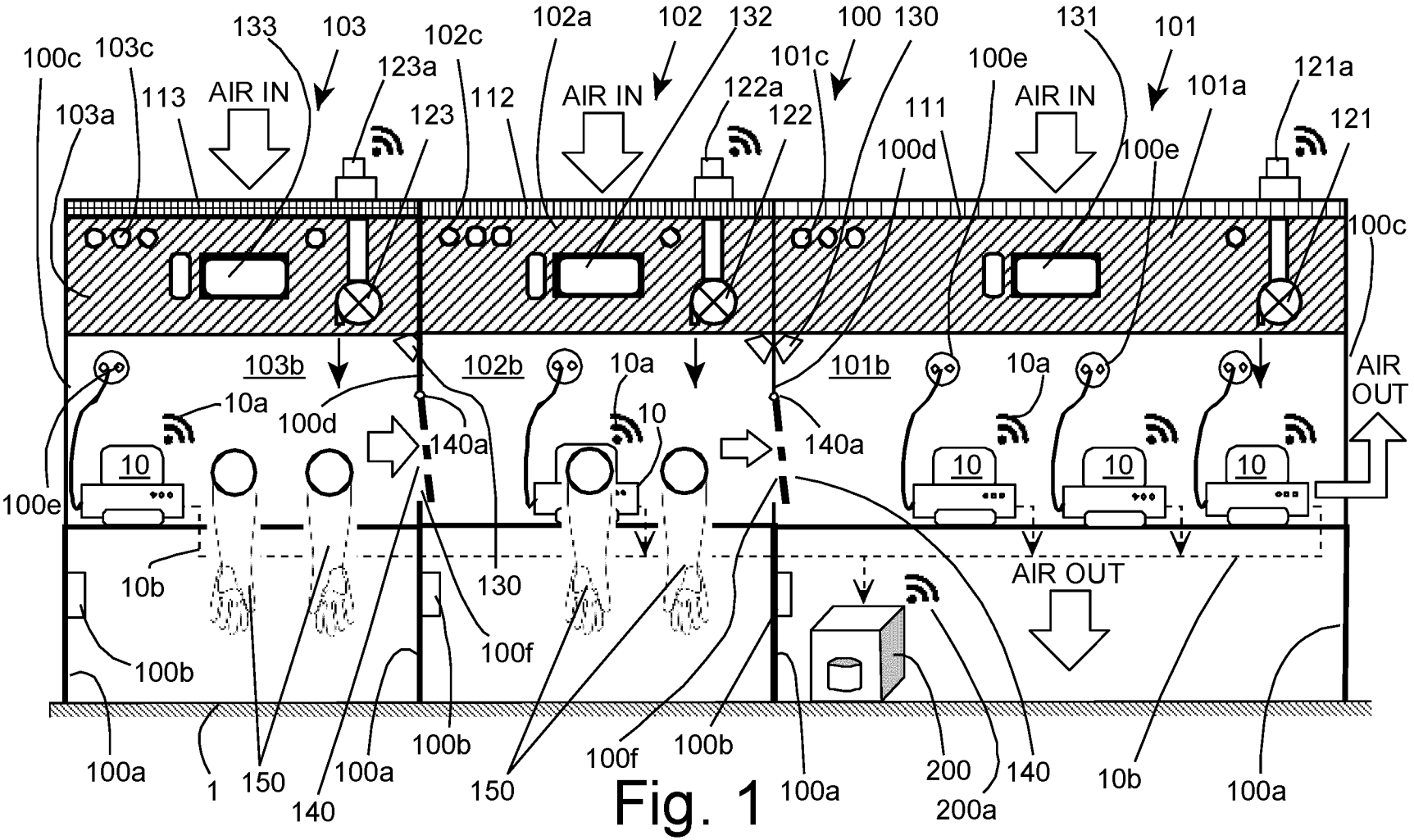
FIG. 1 an example of a clean room facility according to the disclosure for use in a clean room system according to the disclosure.

For a proper understanding of the invention, in the detailed description below corresponding elements or parts of the invention will be denoted with identical reference numerals in the drawings.

FIG. 1 discloses an example of a clean room facility (reference numeral 100) according to the invention, the clean room facility being characterized by a significantly reduced ground floor foot print, whilst conforming to the highest, internationally standardized classifications for clean room atmospheres.

Figure 2:
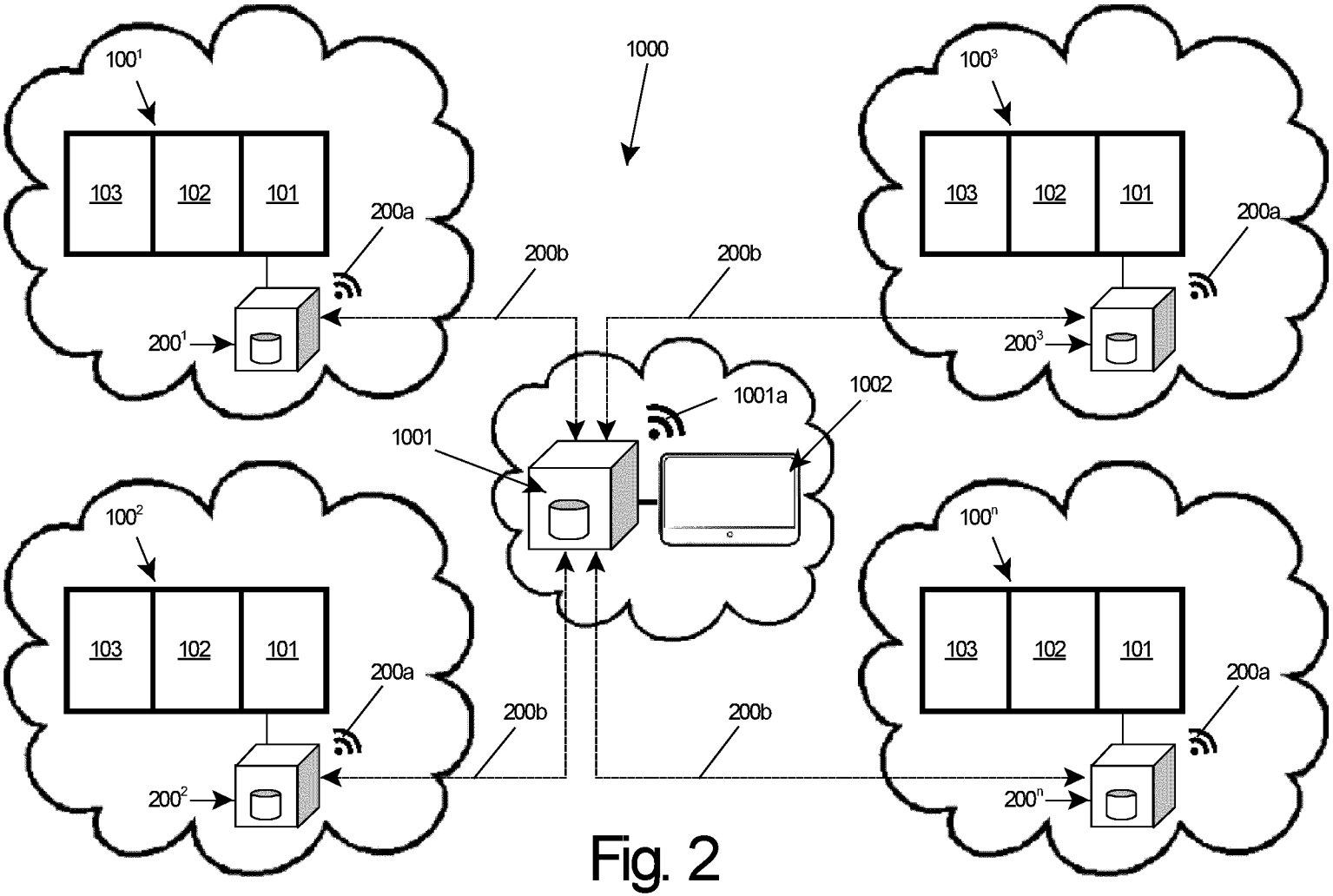
FIG. 2 an example of a clean room system according to the disclosure implementing multiple clean room facilities and a computer implemented method according to the disclosure.

FIG. 2 shows an example of a clean room system 1000 according to the disclosure implementing several clean room facilities $\mathbf{100^1}$-$\mathbf{100^2}$-$\mathbf{100^3}$- . . . -$\mathbf{100^n}$ communicating with a central clean room system control unit 1001 in a data-communications network 200*b*.

In FIG. 1, the clean room facility 100 can be used for example for the manufacturing of a pharmaceutical product or item. Usually, such manufacturing process consists of a sequence of manufacturing steps being performed under extreme low levels of particulates in a single clean room environment conformal to the most stringent clean room classifications and with the assistance of highly qualified staff personnel, complex (clean room) equipment, etc. etc. Due to the necessary presence of air locks, the requirement of wearing protective clothing, etc. presently known clean room systems and facilities have a significant ground floor foot print.

Figure 3A:
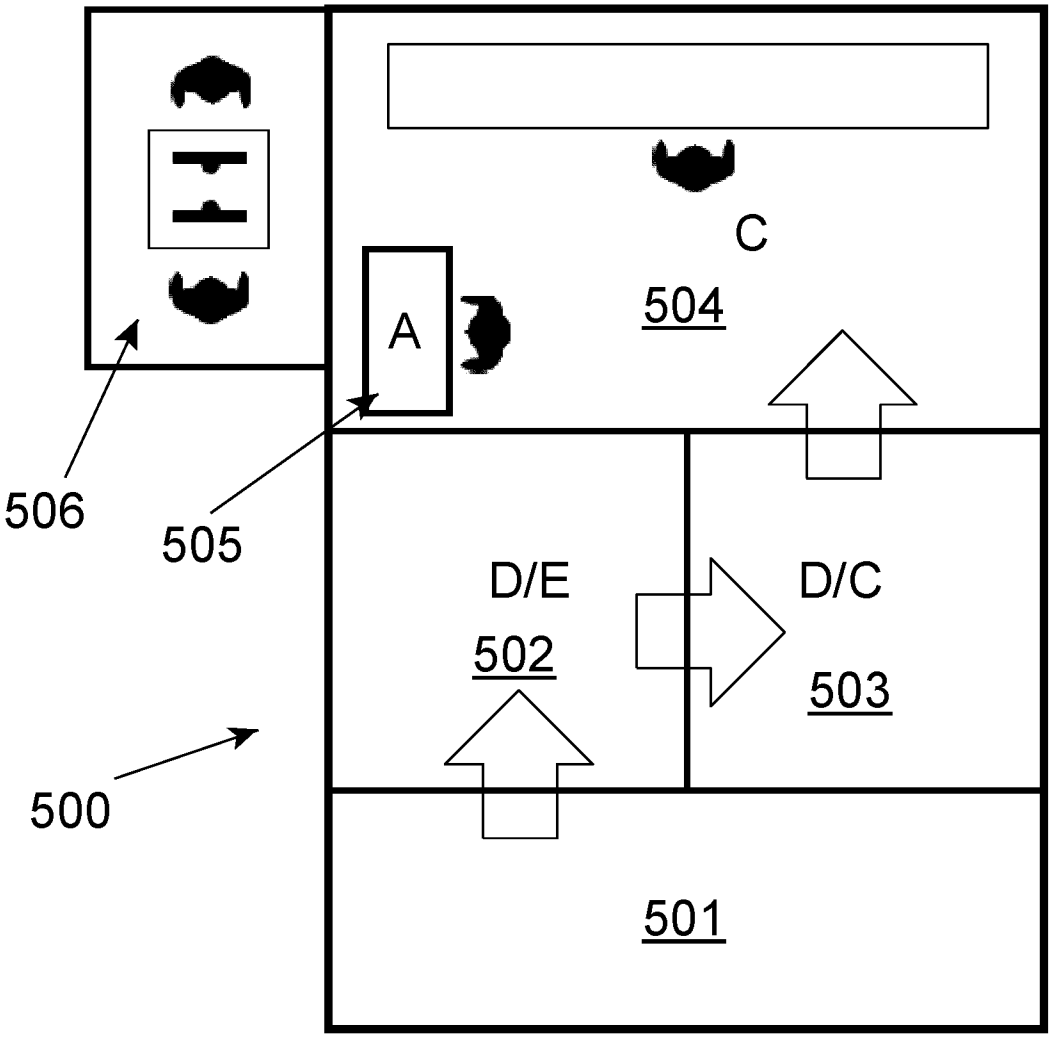
FIG. 3*a* an example of the footprint of a clean room facility according to the state of the art.

In general, such known clean room facilities are complex and expensive, in terms of construction and footprint, the required training of highly skilled personnel, as well as long term maintenance. An example of a known clean room facility according to the state of the art is shown in FIG. 3*a*. The known clean room facility 500 is assembled of several air conditioned compartments 501-502-503-504, with the arrows depicting the direction of access via compartments having a low clean room classification (room 501) towards a compartment 504 having the highest clean room classification B or C.

The first access room 501 is usually a so-called locker room, where laboratory coats and overshoes are stored. From room 501, a first gowning room 502 can be accessed via an airlock (not shown). Room 502 conforms e.g. to a low clean room classification Class D or E. Via room 502 a second gowning room 503 with clean room classification Class D or C can be assessed (again via an airlock). Ultimately, staff personnel enter the actual clean room 504 having e.g. a Class C or B level.

Process steps requiring the highest level of clean room cleanliness (Class A) are to be performed in separate, specifically designed clean room cabinets 505.

Room 506 is used for standard office work, not requiring clean room specifications. Accordingly, room 506 is completely separated from the rooms 501-505, thus preventing any contamination and disturbance of the clean room atmospheres existing in rooms 502-503-504-505.

Accordingly, in FIG. 1, an improved clean room facility is proposed. The clean room facility 100 is composed of multiple air conditioned compartments, here three air conditioned compartments denoted with 101-102-103. Please observe that the clean room facility 100 can be build up in many different configuration of many more air conditioned compartments, for example five (then denoted 101-102-103-104-105) or more. Also a configuration of only two air conditioned compartment 101-102 is possible. In general as many air conditioned compartments can be incorporated in the clean room system For its general purpose each of the multiple air conditioned compartments 101-102-103 are each equipped for performing at least one of the specific manufacturing steps of the manufacturing sequence. Hereto each air conditioned compartments 101-102-103 are constructed in accordance with an associated clean room classification necessary to perform the (one or more) specific manufacturing steps under the required clean room atmospheric conditions maintains in the air conditioned compartments 101-102-103.

For performing the (one or more) specific manufacturing steps under the required clean room atmospheric conditions maintains in the air conditioned compartments 101-102-103 specific dedicated (clean room) equipment or apparatuses 10 can be accommodated in each air conditioned compartment. Although denoted with one reference numeral 10 is should be noted that each (clean room) equipment or apparatus accommodated in either air conditioned compartment 101-102-103 can perform a different manufacturing step.

As shown in FIG. 1, the multiple air conditioned compartments 101-102-103 are mechanically interconnected with each other, thus forming one complete clean room facility 100. The wall sections 100*c*-100*d* of the clean room facility 100/air conditioned compartment 101-102-103 form a space for each air conditioned compartment 101-102-103, the space being indicated with 101*b*-102*b*-103*b*. The complete clean room facility 100 is placed on a support surface 1 by means on supports 100*a*, which can be adjusted in height by means of height setting means 100*b* depending on the staff personnel operating the clean room facility 100.

In general the ground floor footprint of the complete clean room facility 100 is rectangular with each air conditioned compartment 101-102-103 resting on the support surface 1 by means on four supports or legs 100*a*. The staff personnel operating the clean room facility 100 reside outside and next to the several air conditioned compartments forming the clear room facility 100. See also FIG. 3*b*.

The interconnected air conditioned compartments 101-102-103 are each constructed in accordance with an associated clean room classification, which the individual manufacturing step requires. In this example, the associated clean room classifications range from high (classification A) to low (classification C or D) in terms of the number and size of particulates permitted per volume of air in each air conditioned compartment, seen in the direction of the sequence of manufacturing steps. In FIG. 1 the direction of the sequence of manufacturing steps is seen from right to left, from the first air conditioned compartment 101 (class C or D), to the intermediate air conditioned compartment 102 (class B) and finally ending in the final air conditioned compartment 103 (class A).

This means that the first air conditioned compartment 101 has the less stringent clean room atmospheric requirement accepting a high number and large size of particulates per volume of air, and the air conditioned compartment 103 has the most stringent clean room atmospheric requirement accepting a (very) low) number and (very) small size of particulates per volume of air. The clean room atmospheric requirement of the intermediate air conditioned compartment 102 can be either that of the first air conditioned compartment 101 or of the third air conditioned compartment 103, but in general has a number and size of particulates per volume of air, which lies between the less stringent requirement of air conditioned compartment 101 and the most stringent requirement of air conditioned compartment 103.

In an example the air conditioned compartments 101-102-103 fulfill the EU GMP classification, with the first air conditioned compartment 101 having the less stringent clean room requirement classified as EU GMP Grade C (or D), the second air conditioned compartment 102 classified as EU GMP Grade B and the third air conditioned compartment 103 classified as EU GMP Grade A (most stringent).

Accordingly, in this example of FIG. 1, the air conditioned compartment 101 is constructed as semi-closed EU GMP Grade C/D microbiological safety cabinet, whereas the air conditioned compartments 102 and 103 are constructed as closed glove boxes EU GMP Grade A/B, as shown by the gloves 150. The differences in construction also defines the clean room classification associated with the respective air conditioned compartment 101-102-103 and thus also the type of manufacturing steps to be performed in the clean room atmosphere maintained in each air conditioned compartment.

Note, that open processing handlings needs to take place in at least a Grade B or Grade A environment, whereas closed processing handlings can be performed in a Grade C or even under the lowest Grade D environmental conditions.

Each air conditioned compartment 101-102-103 is configured as a (semi)closed box formed of preferably transparent, e.g. made from poly(methyl methacrylate) walls 100*c*-100*d*, which enclose a space 101*b*-102*b*-103*b*. Each air conditioned compartment 101-102-103 furthermore comprises a closed section 101*a*-102*a*-103*a*, either mounted at the top of each box-shaped air conditioned compartment as shown in FIG. 1, or at the bottom of the box-shaped air conditioned compartment. The closed section 101*a*-102*a*-103*a* serves to accommodate several relevant components of the respective air conditioned compartment, such as air filter devices 111-112-113, air filter pump units 121-122-123, input/output interfaces 131-132-133 and detectors 101*c*-102*c*-103*c*.

In the air conditioned compartments 101-102-103, an inert atmosphere is established, typically kept at a higher pressure than the surrounding air, thus forming a pressure cascade, so that any microscopic leaks are mostly leaking inert gas out of the air conditioned compartments instead of letting air in. The pressure cascade prevents contamination from outside into the air-conditioned compartments 101-102-103 during any of the manufacturing steps. Herewith contamination during any of the manufacturing steps is minimized. To this end, each air conditioned compartment 101-102-103 is provided with air filters 111-112-113 mounted on top of each air conditioned compartment for filtering the inflow of air (indicated with AIR IN). The air filters 111-112-113 filter together the air filter pump units 121-122-123 the inflowing air in accordance with the desired clean room air requirements before the filtered air is pumped into the respective space 101*b*-102*b*-103*b* of the air conditioned compartments 101-102-103.

In this example of air conditioned compartment 101 being EU GMP Grade C/D, air conditioned compartment 102 being EU GMP Grade B and air conditioned compartment 103 being EU GMP Grade A, each air filter 111-112-113 is an air filter conformal to the EU GMP Grade associated with the respective air conditioned compartment. In particular, the air filters 111-112-113 are HEPA or ULPA air filter devices conformal with the associated clean room classification.

Although not shown in FIG. 1, in addition to the air filters 111-112-113 each air conditioned compartment 101-102-13 can be provided with one or more UV radiation emitting sources emitting ultraviolet light to disinfect the air, flowing in the air conditioned compartment through their respective air filter 111-112-113.

As stipulated, in the air conditioned compartments 101-102-103, an inert atmosphere is established, typically kept at a higher pressure than the surrounding air, so that any microscopic leak is leaking inert gas out of the air conditioned compartments instead of letting air in. As the air conditioned compartments 101-102-103 have different clean room classifications (according to any internationally accepted clean room standard, such as the EU GMP grading, the US FED STD 209E standard, the BS 5295 standard or the USP800 standard), also the air conditioned compartments 101-102-103 have different pressures kept in the inner spaces 101*b*-102*b*-103*b* thus avoiding an unwanted contaminating air flowing from an air conditioned compartment with a less stringent clean room classification towards an air conditioned compartment with a more stringent clean room classification.

As such, in the example of FIG. 1, with the first air conditioned compartment 101 having the less stringent clean room grade and the third air conditioned compartment 103 having the most stringent clean room grade, the pressure in air conditioned compartment 103 is higher that the pressure inside air conditioned compartment 102, which in turn is higher that the pressure inside air conditioned compartment 101. All air conditioned compartment working pressures are higher than the outer air pressure. Herewith, an unwanted contaminating air flow from the first air conditioned compartment 101 towards the intermediate air conditioned compartment 102, and from the intermediate air conditioned compartment 102 towards the third air conditioned compartment 103 is prevented.

This cascade of pressure differences between air conditioned compartment 103 (high pressure level), air conditioned compartment 102 (medium pressure level) and air conditioned compartment 101 (lowest pressure level, but still higher than the outside atmospheric pressure) creates an internal air flow from the air conditioned compartment 103 towards the air conditioned compartment 101 and subsequent to the outside atmosphere (marked with AIR OUT), thus in a direction seen through the clean room facility which direction is opposite to the direction of the sequence of manufacturing steps (direction from air conditioned compartment 101 towards air conditioned compartment 103) through the clean room facility 100.

To allow the passage of a semi-finished item during its manufacturing sequence from the first air conditioned compartment 101 to the second air conditioned compartment 102 and subsequently to the third air conditioned compartment 103 air permeable transfer passages 140 are present between two mechanically interconnected air conditioned compartments, here air conditioned compartments 101-102 and 102-103. The air permeable character of the transfer passages 140 also allows air flow flowing from the air conditioned compartment 103 (high pressure level), via the air conditioned compartment 102 (medium pressure level) towards the air conditioned compartment 101 (lowest pressure level).

The combination of pressure cascades balanced with the transfer hatches 140 and the additional per compartment filtered inlet air, ensures a safe and clean processing environment for the individual manufacturing steps.

The air permeable transfer passages 140 are formed as an air permeable door, which in one example is hingable around hinge 140*a* and mounted within an air conditioned compartment 101, 102 or 103. Preferably the air permeable transfer passages 140 are hingable around a hinge point 140*a* or slidable mounted with an intermediate wall element 100*d* of the clean room facility 100. The air permeable transfer passages 140 thus shield an opening 100*f* present in the intermediate wall element 100*d*, either through gravity or through other types of closure means such as magnetic couplings, or by means of sliders next to the openings 100*f* in which sliders the intermediate wall element 100*d* is slidable accommodated in an up and down direction.

The staff personnel present besides the several air conditioned compartments forming the clear room facility 100 pass the semi-finished item through the openings 100*f* during its manufacturing sequence from the first air conditioned compartment 101 through the one or more intermediate air conditioned compartments 102 in the direction to the final, here third air conditioned compartment 103. In the final air conditioned compartment with its most stringent clean room environment, the semi-finished item or product undergoes its final manufacturing steps, e.g. a sterilization step and a sealed packaging step and after performing a quality control check the finished item or product is passed in a reverse direction through the openings 100*f* towards the first air conditioned compartment 101. From there it leaves the clean room facility 100 for further handling, such as transportation to a hospital or patient.

To allow a proper monitoring of the manufacturing process of the pharmaceutical product or item the multiple air conditioned compartments 101-102-103 of the clean room facility 11 accommodates at least one but preferably multiple different types of detectors 101*c*-102*c*-103*c*-130. The detectors 101*c*-102*c*-103*c*-130 serve to detect at least one parameter related to the manufacturing step being performed in the air conditioned compartment 101-102-103 and for generating the parameter data in response to the parameter being detected.

As shown in FIG. 1, the several detectors indicated with 101-*c*-102*c*- and 103*c* are accommodated or mounted in the closed section 101*a*-102*a*-103*a* of each air conditioned compartment 101-102-103 can be selected but not limited from the group of a pressure detector, a temperature detector, a humidity detector, an air composition/particle detector, a filtering condition status, a time dimension, etc. Detecting or measuring a pressure, a temperature, an air composition, a humidity or a filtering status of the air filter devices 111-112-113 and air filter pump units 121-122-123 in the space 101*d*-102*d*-103*d* of the respective air conditioned compartment provides real time and accurate information as to the mini-climate conditions inside the air conditioned compartment.

Measuring a time dimension, for example triggered through the opening of one of the air permeable transfer passages 140 or by the activation of one of the (clean room) equipment or apparatus 10 accommodated in either one of the air conditioned compartments 101-102-103 for performing a certain manufacturing step, can provide important information as to the accuracy of the performance of said manufacturing step.

Another aspect or parameter of the related to the manufacturing step being performed being detected or monitored can be the visional imaging of the inner space 101*d*-102*d*-103*d* of each air conditioned compartment by means of a video camera 130 during the performance of said manufacturing step.

The visional imaging of the inner space 101*d*-102*d*-103*d* during the performance of said manufacturing step can be displayed in real time on an output screen being part of the input/output interface 131-132-133 of the associated air conditioned compartment. This allows other staff personnel to also monitor remotely the individual manufacturing steps in the inner space of the airconditioned compartments 101-102-103.

Additionally, when the detector is comprised in a manufacturing device 10 accommodated in the air conditioned compartment 101-102-103 it can also provide additional parameter info related to the manufacturing process itself, such as material parameters (concentration, temperature, etc.) of a pharmaceutical product being processed, or manufacturing parameters, such as volume parameters and flow parameters when handling biological/pharmaceutical products or materials in the tubes and/or sealing parameters such as pressure and temperature to sachets or other types of packages, which needs to be hermitically sealed.

All parameter data (or raw source data) being detected by means of the several detectors 103*a*-102*c*-103*c*-130 can be presented in real time on the output screen of the input/output interface 131-132-133 of the associated air conditioned compartment 101-102-103. The output screen of each input/output interface 131-132-133 can be a touch operated screen for inputting (through the staff personnel working on-site) setting data pertaining to several parameters being monitored and relating to the specific manufacturing step performed in the associated air conditioned compartment. Parameter data which can be set via the input/output interface 131-132-133 and also can be displayed and monitored in real time, can be e.g. but not limited to the operational filtering status of the air filter devices 111-112-113 and air filter pump units 121-122-123, a temperature, a pressure, a humidity and an air composition within the space 101*b*-102*b*-103*b* of the air conditioned compartment.

For a more effective control of the manufacturing processes taking place in the several air conditioned compartments of the clean room facility 100, the clean room facility 100 comprises also a clean room facility control unit 200, which located at the site of each clean room facility. In this embodiment the clean room facility control unit 200 is located within the frame or housing of the clean room facility 100. As shown in FIG. 1, the clean room facility control unit 200 is structured for obtaining and storing all kind of parameter data pertaining to parameters related to the manufacturing steps of the pharmaceutical product or item being performed at the associated air conditioned compartments 101-102-103, as detailed above.

Hereto, the clean room facility control unit 200 is connected via signal lines 10*b* with the several (pressure, temperature, humidity, air composition, time dimension) detectors 101*c*-102*c*-103*c* and/or the air filter devices 111-112-113 and/or the air filter pump units 121-122-123 and/or the cameras 130 and/or the air permeable transfer passages 140 and/or at least one of the equipment apparatuses 10 and stores the various parameter data being generated in response to the parameter being detected. Said parameter data can be stored in real time on a suitable storage device within the clean room facility control unit 200 during the manufacturing process.

The storage of the parameter data at the storage device of the clean room facility control unit 200 can be performed in real time and simultaneously with additional information, such as an associated data stamp and time stamp indication indicating the data/time of generation of that parameter data, as well as with an identification code (ID-code) of the local staff personnel performing the associated manufacturing steps and thus primarily responsible for generating that parameter data.

All parameter data collected and stored in real time together with the additional data/time stamp data and if required also the ID-code of the local staff form an electronic log associated with the manufacturing batch of the pharmaceutical product or item being manufactured at that time. The electronic log can also contain information whether the parameter data is out-of-spec. The electronic log can be transmitted as an electronic file to the clean room system control unit 1001 for monitoring and comparison purposes with desired, pre-determined manufacturing process parameters, as detailed in connection with FIG. 2.

The signal lines 10*b* as well as power supply lines of the equipment apparatuses 10 and other cable periphery present in either inner space 101*b*-102*b*-103*b* can be safely guided out of each inner space 101*b*-102*b*-103*b* through cable guidance openings 100*e* present in a wall section 100*c* of each air conditioned compartment 101-102-103. The cable guidance openings 100*e* are provided with small opening for guiding the cable periphery etc. including the signal lines 10*b* without adversely affecting the mini-climate conditions in each inner space 101*b*-102*b*-103*b*.

Alternatively, the clean room facility control unit 200 is provided with a data-communication interface 200*a*, which allows data exchange with the several (pressure, temperature, humidity, air composition, time dimension) detectors 101*c*-102*c*-103*c* and/or the air filter devices 111-112-113 and/or the air filter pump units 121-122-123 and/or the cameras 130 and/or the air permeable transfer passages 140 and/or at least one of the equipment apparatuses 10, which are likewise provided with a data-communication interface (for example indicated with reference numeral 121*a*-122*a*-123*a* mounted at each closed section 101*a*-102*a*-103*a* and reference numeral 10*a* associated with the several equipment apparatuses 10).

Figure 3B:
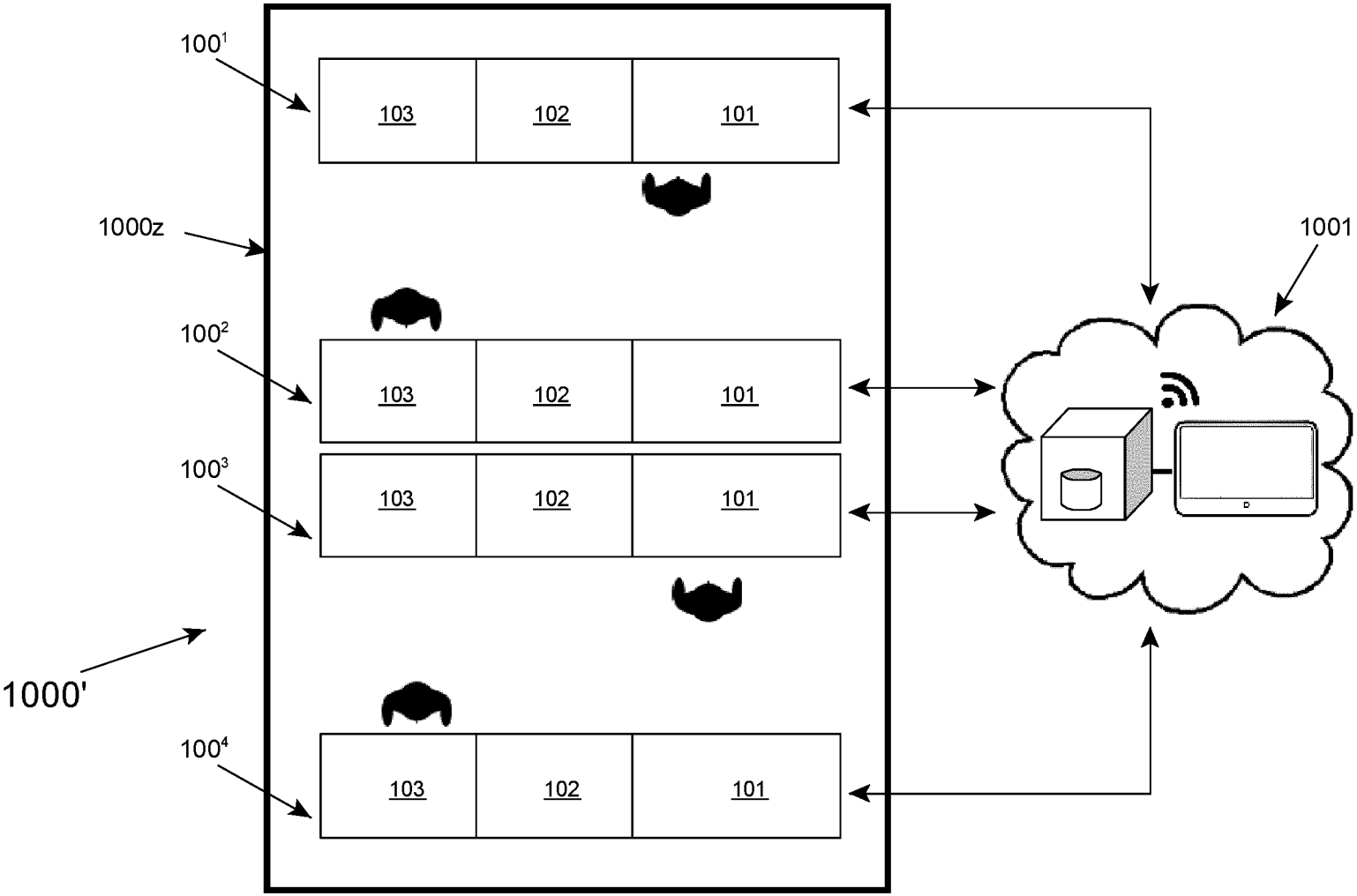
FIG. 3*b* an example of the footprint of a clean room facility according to the disclosure.

According to the disclosure and as shown in FIG. 2 or FIG. 3*b*, one or more clean room facilities 100 as detailed above in combination with FIG. 1, can be accommodated in a clean room system, denoted with reference numeral 1000 in FIG. 2 or with reference numeral 1000' in FIG. 3*b*. In this example, a clean room system 1000 (1000') according to the disclosure implements several clean room facilities $\mathbf{100}^1$-$\mathbf{100}^2$-$\mathbf{100}^3$- . . . -$\mathbf{100}^n$, each clean room facility $\mathbf{100}^1$-$\mathbf{100}^2$-$\mathbf{100}^3$- . . . -$\mathbf{100}^n$ operating independently from each other as to the manufacturing of a pharmaceutical product or item, which can be the same or different pharmaceutical product or item.

The clean room system 1000 (1000') comprises—next to the several clean room facilities 100$^1$-100$^2$-100$^3$- . . . -100$^n$—a clean room system control unit 1001. The clean room system control unit 1001 is located remote from the site of each of the clean room facilities 100$^1$-100$^2$-100$^3$- . . . -100$^n$. Each clean room facility 100$^1$-100$^2$-100$^3$- . . . -100$^n$ has each own clean room facility control unit 200$^1$-200$^2$-200$^3$- . . . -200$^n$ as detailed above, and the clean room facility control units 200$^1$-200$^2$-200$^3$- . . . -200$^n$ and the remote clean room system control unit 1001 are operatively interconnected which each other in a data-communication network 200*b*.

Hereto, each clean room facility control unit 200$^1$-200$^2$-200$^3$- . . . -200$^n$ is provided with a data-communication interface 200*a*, whereas the remote clean room system control unit 1001 comprises a data-communication interface 1001*a*. Preferably the clean room system 1000 (1000') provides a cloud-based yet privacy-secure data-communication network 200*b* via the world wide web.

The several clean room facility control units 200$^1$-200$^2$-200$^3$- . . . -200$^n$ communicate with the central clean room system control unit 1001 via the data-communications network 200*b* and transmit via the data-communication network 200*b* the several, individual parameter data as outlined above in the form of an electronic log file (with data/time stamp and ID-code indication) to the clean room system control unit 1001. In an practical example, the remote clean room system control unit 1001 can be located in Europe, whereas the several autonomous operating clean room facilities 100$^1$-100$^2$-100$^3$- . . . -100$^n$ are located in different countries in the world, such as in Africa, South America and Asia for the local, on-site manufacturing of a (same or different) pharmaceutical product or item. This example is depicted in FIG. 2.

In the example of FIG. 3*b*, the several autonomous operating clean room facilities 100$^1$-100$^2$-100$^3$- . . . -100$^n$ are located at the same premises or geographical location, denoted by reference numeral 1000*z*. Also in FIG. 3*b* it is clearly shown, that the staff personnel operating the several clean room facilities 100$^1$-100$^2$-100$^3$- . . . -100$^n$ reside outside and next to the several air conditioned compartments 101-102-103. As only the several air conditioned compartments 101-102-103 have an over pressurized inner atmosphere, the building space 1000*z* itself is not over pressurized. Accordingly, the staff personnel do not need to work in over pressured environments, further improving working conditions. In additional, the staff personnel do not need to dress in protective clothing, which significantly simplifies the operation of such clean room system and facility, as gowning/ungowning rooms are obviated.

According to the disclosure, the remote clean room system control unit 1001 is structured to receive, via the data-communication network 200*b*, the parameter data transmitted (as an electronic log file) from one or more clean room facility control units 200$^1$-200$^2$-200$^3$- . . . -200$^n$ and to compare automatically the parameter data with pre-determined reference parameter data.

The reception of the transmitted parameter data can be automated, and similarly the comparison of the parameter data received with pre-determined reference parameter data can be performed automatically by means of computer software program or product, which comprises instructions which, when the program is executed by a computer, such as the remote clean room system control unit 1001 cause the remote clean room system control unit 1001 to carry out the steps of the computer implemented method according to the disclosure.

Alternatively, a computer-readable storage medium being part of the clean room system control unit 1001 may comprise instructions, which, when executed by a clean room system control unit 1001, cause the clean room system control unit 1001 to carry out steps of the computer implemented method.

In another alternative, this off-site control can be performed by high qualified staff personnel working at the off-site clean room system control unit 1001, which subsequently are not needed to be employed at the site of the clean room facility 100$^1$-100$^2$-100$^3$- . . . -100$^n$ where the actual manufacturing process is taking place.

For example, the clean room system control unit 1001 can control the manufacturing process at the associated clean room facility 100$^1$-100$^2$-100$^3$- . . . -100$^n$, based on the comparison between the process parameter data being measured or detected with the desired, pre-determined process parameter data. This controlling of the manufacturing process can for example include quality approval and release (for use or selling) of the pharmaceutical product or item being manufactured, adapting the manufacturing process, or even interrupting (temporarily or permanent) the manufacturing process in the event that the comparison shows the measured process parameters being out-of-spec. This is a requirement when the clean room facilities 100$^1$-100$^2$-100$^3$- . . . -100$^n$ are being operated under strict clean room conditions, wherein the several manufacturing steps for the manufacturing of the pharmaceutical product or item are to be processed under strict EU GMP requirements.

For example, the temporarily or permanent interrupting of the manufacturing process at one of the clean room facilities 100$^1$-100$^2$-100$^3$- . . . -100$^n$ can be decided if the acquired parameter data does not concur with the pre-determined reference parameter data, for example when the comparison does not show an identical match or when there is a sufficient mismatch, e.g. when the acquired parameter data does not fall within a pre-determined range around the pre-determined reference parameter data (for example+/−1%-5%).

In the latter example, the manufacturing process of the pharmaceutical product or item at the associated clean room facility 100$^1$-100$^2$-100$^3$- . . . -100$^n$ can be interrupted from the clean room system control unit 1001, automatically or at the command of staff personnel at the clean room system control unit 1001, e.g. by generating and sending proper command instructions from the clean room system control unit 1001 via the data communications network 200*b* to the associated clean room facility 100$^1$-100$^2$-100$^3$- . . . -100$^n$.

The command instructions can for example shut down a certain equipment apparatus 10 thus interrupting the manufacturing step being performed by said equipment apparatus. Similarly, a command instruction can be sent to the associated clean room facility blocking one or more of the air permeable transfer passages 140 from opening, (e.g. by remote activation of the closing means of the air permeable transfer passage 140), thus preventing the removal of an pharmaceutical product or item, which does not fulfill the manufacturing specifications.

Once the manufacturing process at the associated clean room facility 100$^1$-100$^2$-100$^3$- . . . -100$^n$ is interrupted based on the comparison, either the clean room system control unit 1001—alone or assisted by local staff personnel—can review from the site remote from the at least one clean room facility, the sequence of manufacturing steps and the parameter data at the associated clean room facility 100$^1$-100$^2$-100$^3$- . . . -100$^n$.

This allows the local staff personnel at the clean room system control unit 1001 to review the whole manufacturing process, for example by using an input/output interface 1002 which can incorporate a touch operated screen for inputting setting data or for displaying relevant parameter data, check for any manufacturing errors or manufacturing malfunctions, and to adapt the sequence of manufacturing steps and the parameter data at the associated clean room facility. Ultimately, the manufacturing of the pharmaceutical product or item being performed at the associated clean room facility can be restarted once the manufacturing errors or manufacturing malfunctions, which caused the interruption due to a mismatch between the acquired parameter data and the pre-determined reference parameter data.

As the air conditioned compartments 101-102-103 can be equipped with a video camera 130, the local staff personnel at the clean room system control unit 1001 can set up a video link with the remote clean room facility 100 and visually review the inner space of the relevant air conditioned compartments. If needed, the manufacturing process can be restarted by providing proper instructions via the video link to the staff personnel operating the remote clean room facility 100.

From the above disclosure, a clean room system and clean room facility is obtained with a significant reduction of the ground floor foot print of the overall clean room facility as complex technical measures, such as air locks etc. can be obviated. Also the staff personnel on site do not need to dress in protective clothing, which significantly simplifies the operation of such clean room system and facility. Moreover, overall governance and quality assurance of the manufacturing process of a pharmaceutical product or item is maintained, allowing the manufacturing of the pharmaceutical product or item at different locations around the world.

The latter advantage of having manufacturing facilities for pharmaceutical products or items under strictly quality controlled conditions is in particular beneficial for pharmaceutical products which require manufacturing on demand, for example because pharmaceutical product has a time-limited effectiveness requiring fast delivery to a hospital or patient.

The invention claimed is:

1. A clean room system for the manufacturing of a pharmaceutical product or item according to a sequence of manufacturing steps under extreme low levels of particulates in accordance with internationally standardized classifications of atmospheric cleanliness, the clean room system comprising at least one clean room facility being composed in a modular manner of multiple air conditioned compartments mechanically interconnected, with, during use, the staff personnel operating the clean room facility outside and next to the multiple air conditioned mechanically interconnected compartments forming the clean room facility, each of the multiple air conditioned compartments equipped for performing at least one of the manufacturing steps, wherein the multiple air conditioned compartments are mechanically interconnected by means of intermediate wall elements, each intermediate wall element being provided with an air permeable transfer passage and each of the multiple air conditioned compartments are constructed in accordance with an associated clean room classification decreasing in terms of the number and size of particulates permitted per volume of air, when seen in the direction of the sequence of manufacturing steps through the clean room facility from an air conditioned compartment having a least stringent clean room atmospheric requirement towards an air conditioned compartment having a most stringent clean room atmospheric requirement of the multiple modular interconnected air conditioned compartments.

2. The clean room system according to claim 1, further comprising at least one clean room facility control unit located at the site of each of the at least one clean room facility, as well as a clean room system control unit located remote from the site of each of the at least one clean room facility, both at least one clean room facility control unit and the remote clean room system control unit being operatively interconnected in a data-communication network, wherein the clean room facility control unit is structured for obtaining and storing parameter data pertaining to parameters related to the manufacturing steps of the pharmaceutical product or item being performed at the associated clean room facility, as well as transmitting, via the data-communication network, the parameter data to the clean room system control unit and wherein the clean room system control unit is structured to:

receive, via the data-communication network, the parameter data transmitted from the at least one clean room facility control unit, compare the parameter data with pre-determined reference parameter data, and controlling, based on the comparison, the manufacturing of the pharmaceutical product or item being performed at the associated clean room facility.

3. The clean room system according to claim 1, wherein each of the multiple air conditioned compartments is provided with a HEPA or ULPA air filter device conformal with the associated clean room classification.

4. The clean room system according to claim 1, wherein the air permeable transfer passage is formed as an air permeable door, which is hingable or slidable mounted with an air conditioned compartment.

5. The clean room system according to claim 1, wherein each of the multiple air conditioned compartments of the at least one clean room facility accommodates at least one detector for detecting at least one parameter related to the manufacturing step being performed in the respective compartment and for generating the parameter data in response to the parameter being detected.

6. The clean room system according to claim 5, wherein the at least one detector is comprised in a manufacturing device accommodated in at least one air conditioned compartment of the multiple air conditioned compartments.

7. The clean room system according to claim 6, wherein the at least one detector is one selected but not limited from the group of a pressure detector, a temperature detector, a humidity detector, an air composition detector, a video camera, a time dimension.

8. The clean room system according to claim 5, wherein the at least one detector is one selected but not limited from the group of a pressure detector, a temperature detector, a humidity detector, an air composition detector, a video camera, a time dimension.

9. The clean room system according to claim 1, wherein at least one of the multiple air conditioned compartments comprises an input/output interface for inputting setting data pertaining to at least one parameter related to a manufacturing step and for displaying parameter data pertaining to at least one parameter related to the manufacturing step being performed in the at least one of the multiple air conditioned apartments.

10. The clean room system according to claim 1, wherein at least one of the multiple air conditioned compartments of each clean room facility is constructed as a glove box.

11. A computer implemented method for controlling a clean room system according to claim 1, the method comprising the steps of:

monitoring, at a site remote from the at least one clean room facility, the sequence of manufacturing steps for manufacturing of a pharmaceutical product or item at the at least one clean room facility, acquiring parameter data pertaining to parameters related to the manufacturing steps being performed at the associated clean room facility, comparing, at the site remote from the at least one clean room facility, the acquired parameter data with pre-determined reference parameter data, and controlling, based on the comparison, the manufacturing of the pharmaceutical product or item being performed at the associated clean room facility.

12. The computer implemented method for controlling a clean room system according to claim 11, wherein the step of controlling comprises the steps of:

interrupting the manufacturing of the pharmaceutical product or item being performed at the associated clean room facility if the acquired parameter data does not concur with the pre-determined reference parameter data;

reviewing, from the site remote from the at least one clean room facility, the sequence of manufacturing steps and the parameter data at the associated clean room facility, adapting, from the site remote from the at least one clean room facility, the sequence of manufacturing steps and the parameter data at the associated clean room facility, and restarting the manufacturing of the pharmaceutical product or item being performed at the associated clean room facility.

13. A computer program or computer program product comprising instructions which, when executed by a computer, cause the computer to carry out steps of the computer implemented method according to claim 11.

* * * * *